US007017924B1

(12) United States Patent
Lambert

(10) Patent No.: US 7,017,924 B1
(45) Date of Patent: Mar. 28, 2006

(54) FOLDABLE BABY WALKER

(76) Inventor: Marie A. Lambert, 13105 Oriole Dr., Beltsville, MD (US) 20705

( * ) Notice: Subject to any disclaimer, the term of this patent is extended or adjusted under 35 U.S.C. 154(b) by 0 days.

(21) Appl. No.: 11/122,901

(22) Filed: May 6, 2005

(51) Int. Cl.
*B62B 7/06* (2006.01)

(52) U.S. Cl. ..... 280/87.051; 280/642; 280/650; 297/5; 297/6

(58) Field of Classification Search ..... 280/87.051, 280/87.01, 87.021, 87.041, 87.03, 87.05, 280/650, 639, DIG. 3, DIG. 4, 641, 642, 280/643, 644, 649; 297/5, 6, 136, 344.18
See application file for complete search history.

(56) References Cited

U.S. PATENT DOCUMENTS 3,059,963 A * 10/1962 Hamilton et al. ..... 297/5
3,194,577 A * 7/1965 Berlin ..... 280/643
3,337,230 A * 8/1967 Golding ..... 280/87.03
3,754,786 A * 8/1973 Boucher et al. ..... 297/5
3,759,539 A * 9/1973 Goldberg ..... 280/87.03
3,884,495 A * 5/1975 Petock ..... 280/87.041
4,045,045 A * 8/1977 Boucher et al. ..... 280/87.051
4,171,847 A 10/1979 Tukui
4,226,467 A 10/1980 Boudreau
4,231,582 A * 11/1980 Moss ..... 280/87.051
4,245,850 A * 1/1981 Boudreau ..... 280/87.051
4,359,242 A 11/1982 Gerken et al.
4,762,256 A * 8/1988 Whitaker ..... 224/161
5,050,862 A * 9/1991 Saghafi ..... 482/68
D408,766 S 4/1999 Rodgers
6,481,730 B1 * 11/2002 Sung ..... 280/87.05
6,527,285 B1 * 3/2003 Calandro, II ..... 280/87.051
6,837,503 B1 * 1/2005 Chen et al. ..... 280/87.021
2002/0038942 A1 * 4/2002 Gilles et al. ..... 280/87.051

* cited by examiner

*Primary Examiner*—J. Allen Shriver

(57) ABSTRACT

A child's walker includes a pair of oppositely spaced A-frames provided with wheels conjoined to a lower portion thereof. Each A-frame has an apex centrally positioned above the wheels and pivotal about the apexes. A semi-spherical seat section is nested intermediate of the A-frames and includes an anchor bracket conjoined to an anterior surface thereof for maintaining the seat section at a stable position. The seat section has a pair of spaced openings for receiving the child's legs therethrough, and is formed from flexible, padded material. Such a seat section is adjustably pivotal about a horizontal fulcrum axis passing through the A-frame apexes. A tray is mateable to the anchor bracket and protrudes horizontally from the seat section. The tray is disengageable from the anchor bracket for assisting a caregiver to fold the walker to a compact shape during transport.

18 Claims, 5 Drawing Sheets

FOLDABLE BABY WALKER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to baby walkers and, more particularly, to a foldable baby walker for promoting the safety and comfort of a child.

2. Prior Art

There are numerous different types of children's walkers, some of which have annular or ring-type bases. One problem with walkers of that general type is the difficulty in storing them because the ring-type base is fairly large, in the order of three feet in diameter and the seat projects two to three feet below the ring. Thus, a parent must either clear a significant amount of space to enable storage in a closet or leave the walker where it may get in the way.

A number of different types of child walkers are currently available on the market that are foldable so as to facilitate carrying and to enable storage in areas of restricted space. Prior walkers of this type, however, often include complex release mechanisms which must be manipulated to move the walkers into a folded position. In many cases, for reasons of safety, the release mechanisms are intentionally made difficult to operate to prevent the accidental or improper collapse of the walker by a child seated therein. In one prior walker, for example, portions of the support frame must be physically detached from one another before the walker can be folded.

Another prior walker includes four supporting leg members, each of which includes a separate mechanism which must be released to fold the walker. Such mechanisms are difficult to operate even when a child is not seated in the walkers. Additionally, such mechanisms are expensive to manufacture, and increase the overall cost of the walkers significantly.

Many toddlers and infants that use walkers are at the appropriate age where they start teething. As is well known, this process causes the child's gums to become irritated, itchy and some times painful. In order to alleviate the irritation and itchiness associated with teething, parents often provide their toddlers with chew rings, etc. that they may use to bite on, and in effect, scratch their gums with. A problem arises though, when a toddler uses such a chew ring while they are in a walker. If the chew ring is dropped and falls on the floor it needs to be cleaned and the child cannot reach the chew on the floor while in the walker. Thus, an affixed chewing apparatus would be appropriate.

Parents are also often required to remove their child from a walker when it comes time to feed them, because there is no suitable surface on the walker to feed them from. This is time and energy consuming, and may become increasingly difficult to do as the child grows older and heavier. Having a tray conveniently disposable on the walker would greatly assist in alleviating this issue.

Accordingly, a need remains for a foldable baby walker in order to overcome the above-noted shortcomings. The present invention satisfies such a need by providing a baby walker that is easy and comfortable to use, portable and foldable in design, and durable in construction. Such a walker's metal frame and cloth seat folds compactly, and is thus, easy to carry and store, making it convenient to use. Furthermore, using the walker advantageously eliminates the need to leave an infant or toddler on a dirty carpet or floor where they can easily become exposed to bacteria and other germs. The walker's removable tray also allows a child to be easily fed while sitting in the walker. Such a walker conveniently allows a parent to relax and enjoy themselves as they keep and eye on their child.

BRIEF SUMMARY OF THE INVENTION

In view of the foregoing background, it is therefore an object of the present invention to provide a foldable baby walker. These and other objects, features, and advantages of the invention are provided by a child's walker for promoting safety and comfort.

The child's walker includes a pair of oppositely spaced A-frames provided with a plurality wheels directly conjoined to a lower portion thereof respectively. Each A-frame has an apex centrally positioned above the wheels respectively wherein the A-frames are pivotal about the respective apexes. Each A-frame preferably includes a foldable hinge that has opposed end portions directly conjoined to a medial region of the A-frames respectively. Such foldable hinges are adaptable between folded and expanded positions so that the A-frames can effectively be biased between inoperable and operable positions respectively.

A seat section that has a semi-spherical shape is nested intermediate of the A-frames such that a child's legs can advantageously freely move about when the child is seated within the seat section. The seat section preferably includes a pair of detachably engageable straps that have lateral end portions directly and permanently attached to the seat section.

Such a seat section further includes a rigid anchor bracket directly conjoined to an anterior surface of the seat section for maintaining the seat section at a substantially stable position during operating conditions. The anchor bracket may be provided with a pair of laterally spaced slots formed therein and positioned adjacent to the A-frames. The tray, in addition, preferably includes a plurality of tabs monolithically formed therewith and protruding downwardly from a bottom surface thereof, wherein the tabs are sized and shaped for being removably coupled with the slots so that the tray can advantageously be maintained at a substantially stable position during operating conditions.

The anchor bracket may further include a plurality of monolithically formed finger portions laterally protruding away from the seat section and centrally registered with the fulcrum axis. The A-frames are provided with a plurality of frame-securing couplings that are effectively threadably mateable with the finger portions in such a manner that the caregiver can conveniently detach the A-frames from the seat section during transport and storage procedures.

The seat section also has a pair of spaced openings for conveniently receiving the child's legs therethrough and is formed from flexible padded material. The seat section is adjustably pivotal about a horizontally registered fulcrum axis passing through the apexes of the A-frames.

A tray is directly mateable to the anchor bracket in such a manner that the tray protrudes horizontally from the seat section for effectively supporting foodstuff thereon. Such a tray is disengageable from the anchor bracket for advantageously assisting a caregiver to fold the walker to a compact shape during transport. The tray preferably includes a cup holder and a teething bar monolithically formed with a top surface of the tray.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
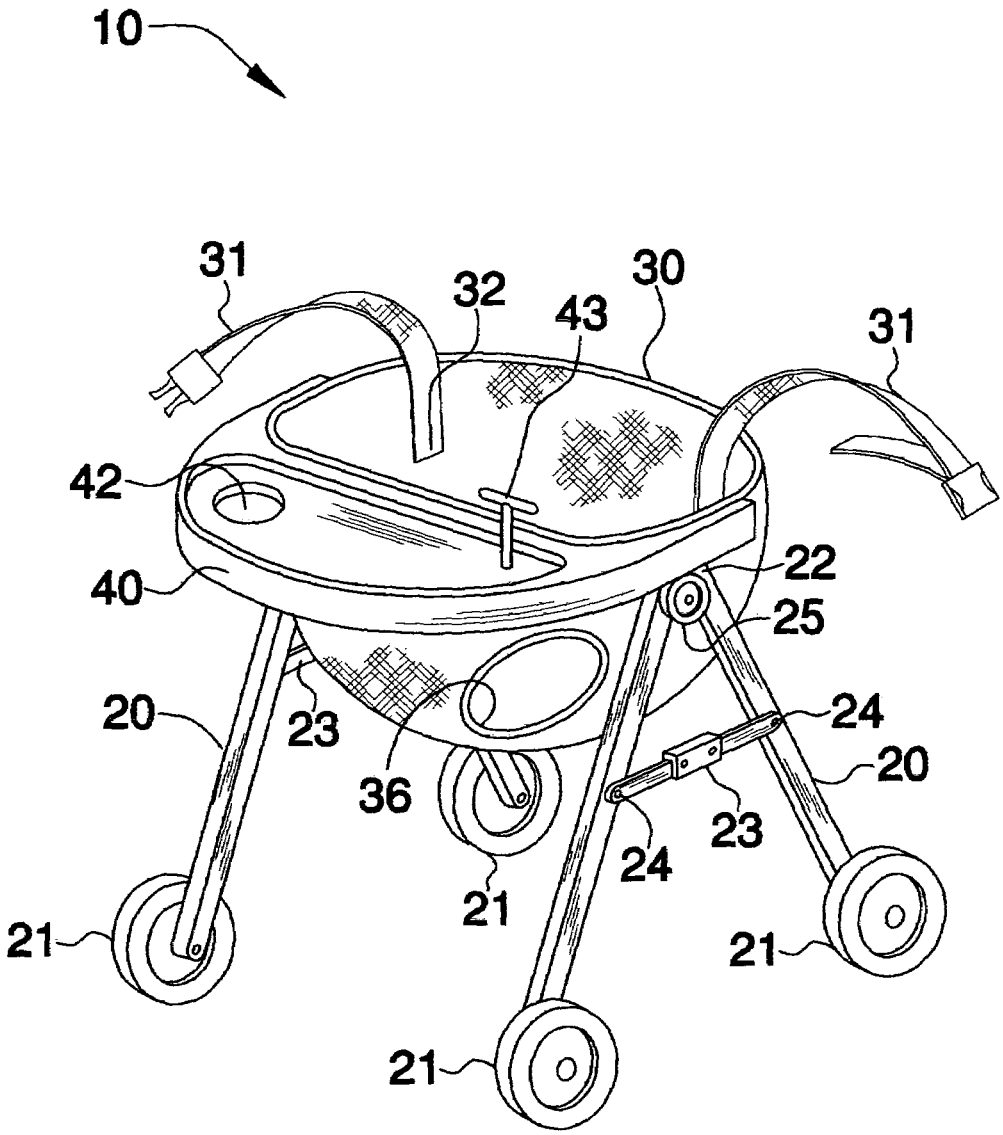
FIG. 1 is a perspective view showing a foldable baby walker, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–6 by the reference numeral 10 and is intended to provide a foldable baby walker. It should be understood that the assembly 10 may be used to hold infants and toddlers of different ages and should not be limited in use to only babies.

Figure 3:
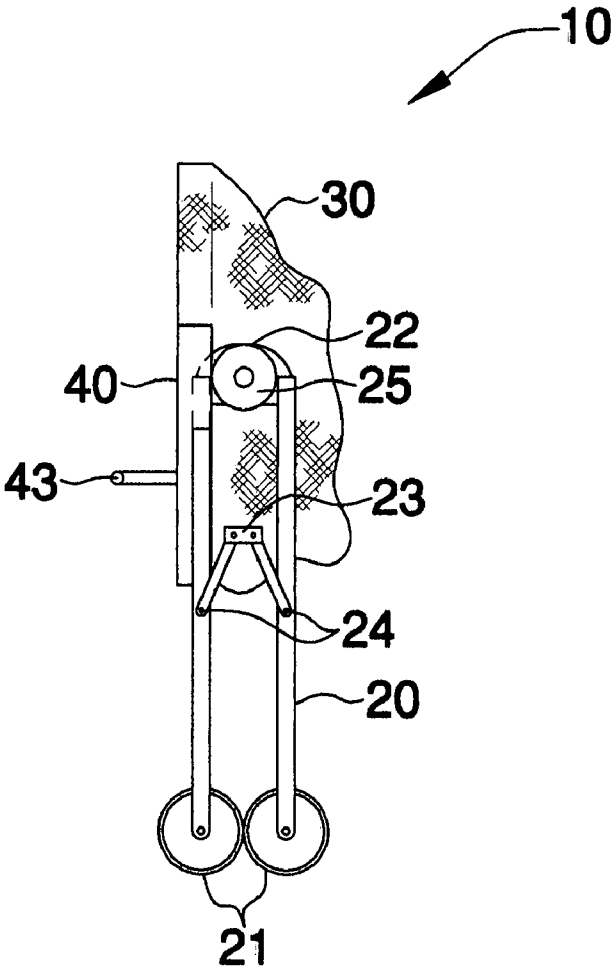
FIG. 3 is a side elevational view of the assembly shown in FIG. 2.
Figure 2:
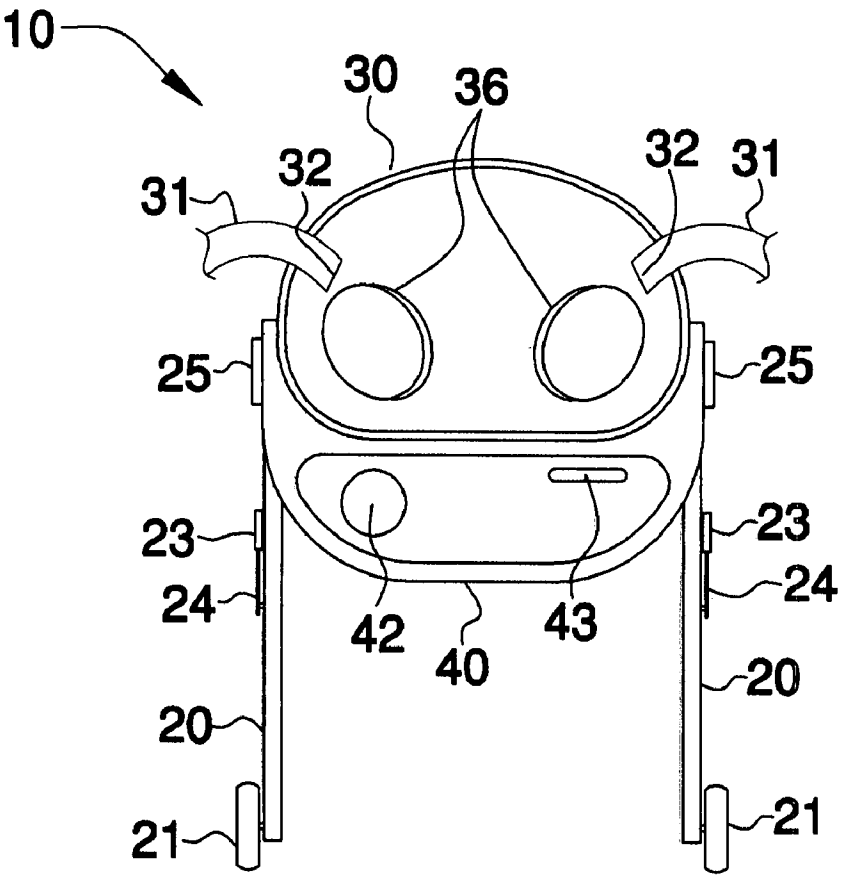
FIG. 2 is a top plan view of the assembly shown in FIG. 1, showing the A-frames at a collapsed and inoperable position.

Referring initially to FIGS. 1 through 3, the assembly 10 includes a pair of oppositely spaced A-frames 20 provided with a plurality wheels 21 directly conjoined, with no intervening elements, to a lower portion thereof respectively. Such A-frames 20 are preferably formed from steel. Of course, aluminum or aluminum alloy may be desirable for this purpose because of its characteristics of light weight and structural rigidity, as is obvious to a person of ordinary skill in the art. Furthermore, the A-frames 20 may be polished, chrome plated, nickel plated, or the like, if desirable. In view of the various kinds and types of plastics now available, the A-frames 20 may also be produced from plastic.

Figure 7:
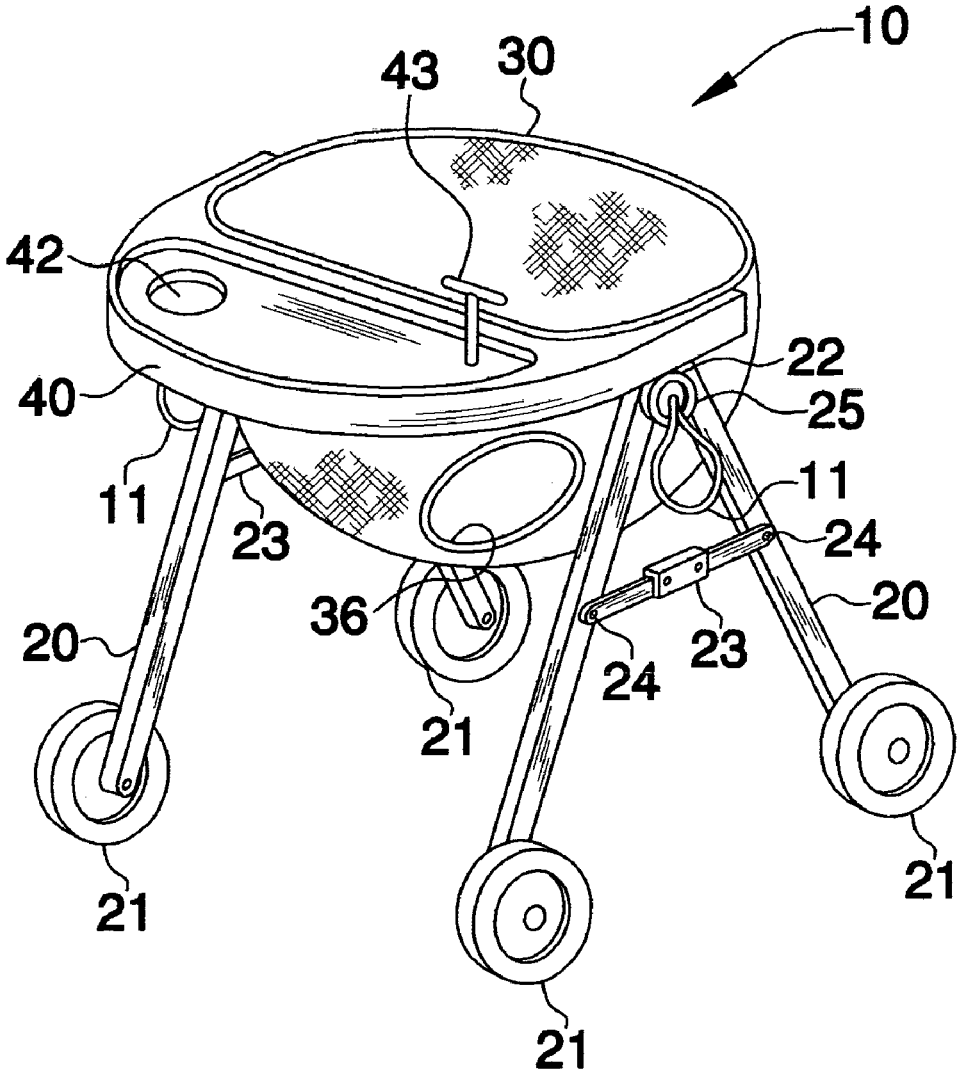
FIG. 7 is a perspective view of a foldable baby walker showing a plurality of carrying straps.

Each A-frame 20 has an apex 22 centrally positioned above the wheels 21 respectively wherein the A-frames 20 are pivotal about the respective apexes 22. Of course, each A-frame 20 may include a flexible handle 11 directly connected, with no intervening elements, thereto, as shown in FIG. 7. Such a handle 11 is preferably formed from a weather resistant nylon material, but may be formed from rope, elastic, or rubber, as is obvious to one having ordinary skill in the art. Each A-frame 20 includes a foldable hinge 23 that has opposed end portions 24 directly conjoined, with no intervening elements, to a medial region of the A-frames 20 respectively. Such foldable hinges 23 are adaptable between folded and expanded positions that are vital so that the A-frames 20 can effectively be biased between inoperable and operable positions respectively, as is best illustrated in FIG. 3.

Referring to FIGS. 1 through 4, a seat section 30 that has a semi-spherical shape is nested intermediate of the A-frames 20, which is essential so that a child's legs can advantageously freely move about when the child is seated within the seat section 30. This feature advantageously allows the child to propel themselves while sitting in the assembly 10, which is both entertaining to the child and beneficial for their leg muscle development. The seat section 30 includes a pair of detachably engageable straps 31 that have lateral end portions 32 directly and permanently attached, with no intervening elements, to the seat section 30. Such straps 31 advantageously allow a parent to securely fasten infants of various sizes within the seat section 30, thus further increasing their safety by preventing the toddler from possibly falling out of the assembly 10.

Figure 4:
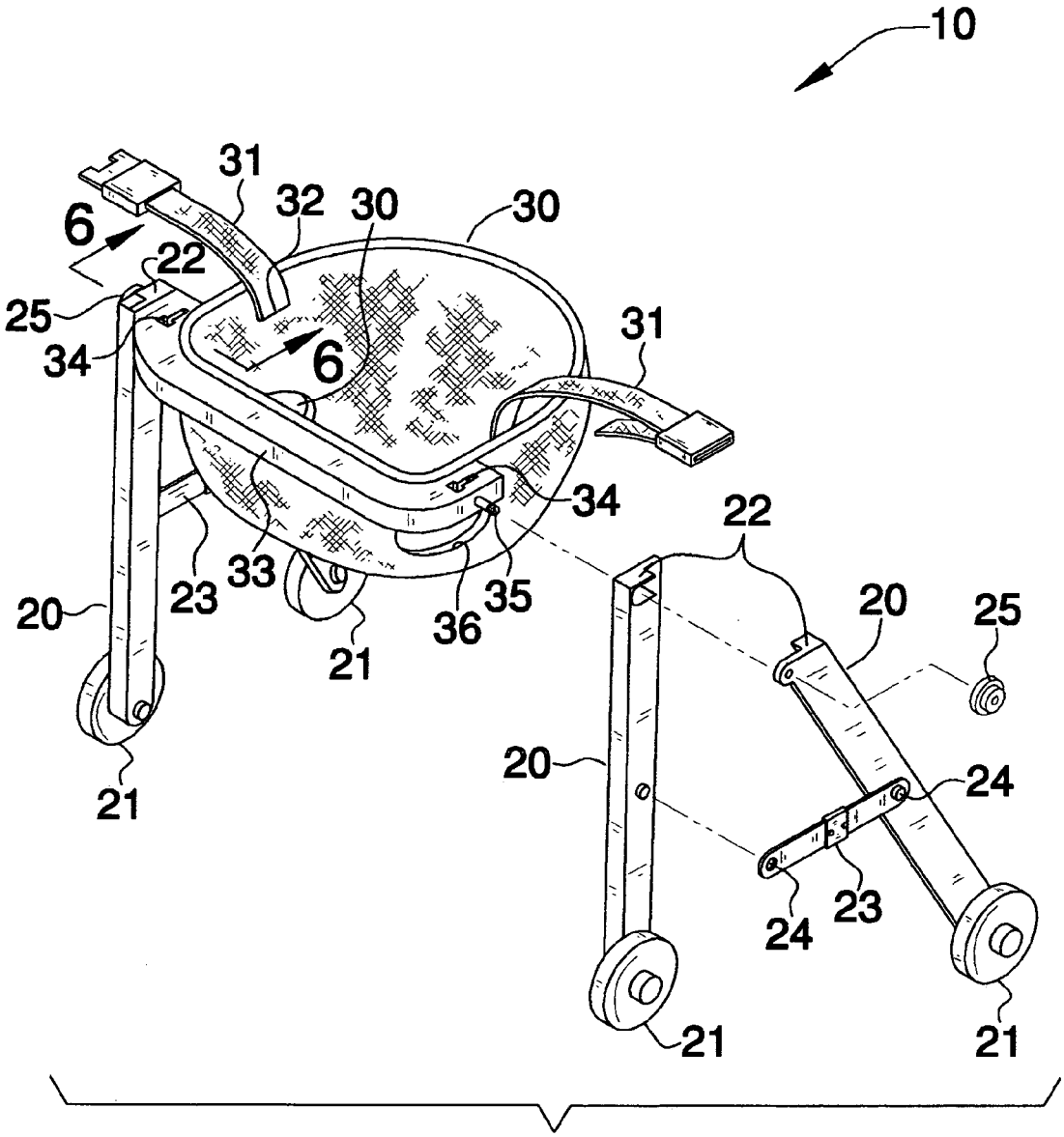
FIG. 4 is a partially exploded perspective view of the assembly shown in FIG. 1, showing the components of the A-frames.
Figure 5:
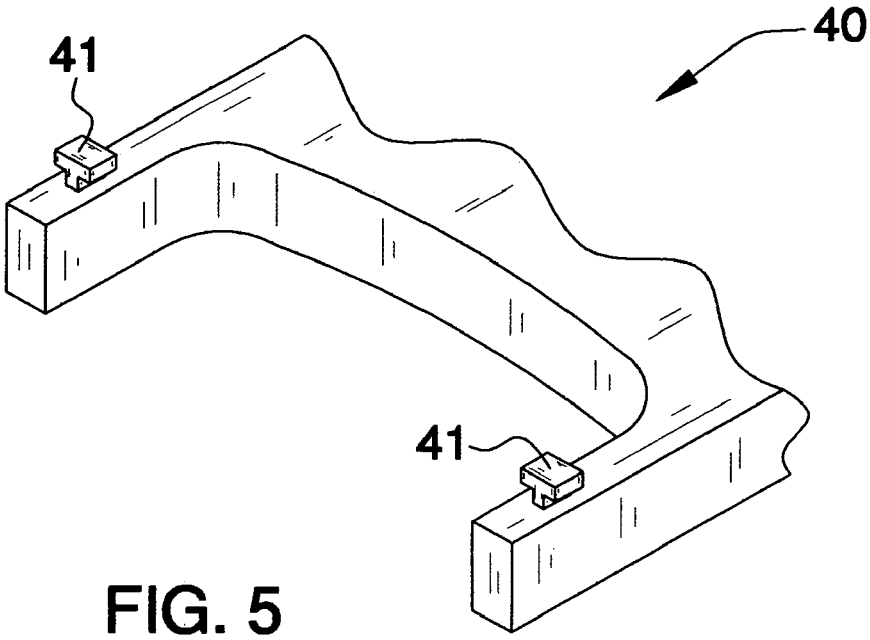
FIG. 5 is an enlarged bottom perspective view of the tray shown in FIG. 1, showing the tabs monolithically formed therewith.
Figure 6:
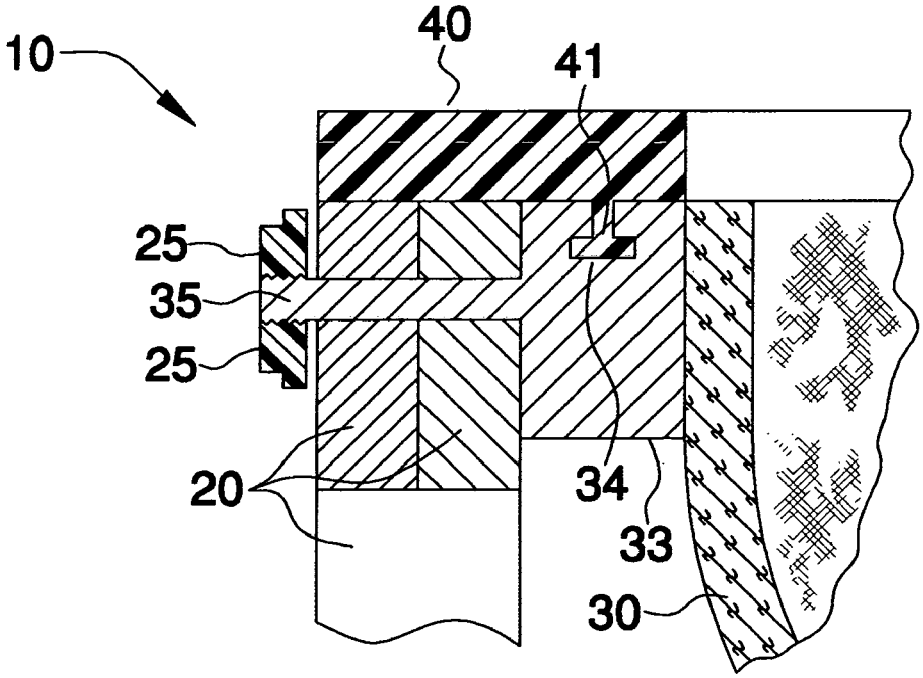
FIG. 6 is a cross-sectional view of the assembly shown in FIG. 4, taken along line 6—6.

Referring to FIGS. 4, 5 and 6, such a seat section 30 further includes a rigid anchor bracket 33 directly conjoined, with no intervening elements, to an anterior surface of the seat section 30 that is critical for maintaining the seat section 30 at a substantially stable position during operating conditions. The anchor bracket 33 is provided with a pair of laterally spaced slots 34 formed therein and positioned adjacent to the A-frames 20. The tray 40 (described herein below), in addition, includes a plurality of tabs 41 monolithically formed therewith and protruding downwardly from a bottom surface thereof, as is best shown in FIG. 5. Such tabs 41 are sized and shaped for being removably coupled with the slots 34, which is important so that the tray 40 can advantageously be maintained at a substantially stable position during operating conditions.

Referring to FIGS. 4 and 6, the anchor bracket 33 further includes a plurality of monolithically formed finger portions 35 laterally protruding away from the seat section 30 and centrally registered with the fulcrum axis. The A-frames 20 are provided with a plurality of frame-securing couplings 25 that are effectively threadably mateable with the finger portions 35 in such a manner that is crucial for allowing the caregiver to conveniently detach the A-frames 20 from the seat section 30 during transport and storage procedures.

Referring to FIGS. 1, 2 and 4, the seat section 30 also has a pair of spaced openings 36 that are essential for conveniently receiving the child's legs therethrough and are formed from flexible padded material, thus ensuring the child remains comfortable during extended periods of use. The seat section 30 is adjustably pivotal about a horizontally registered fulcrum axis passing through the apexes 22 of the A-frames 20. Such a seat section 30 advantageously eliminates the need for a parent to constantly hold their child while also providing a convenient non-restrictive alternative to strapping an infant in an uncomfortable stroller.

Referring to FIGS. 1, 2, 3, 5 and 6, a tray 40 is directly mateable, with no intervening elements, to the anchor bracket 33 in such a manner that the tray 40 protrudes horizontally from the seat section 30, which is vital for effectively supporting foodstuff thereon. Such a tray 40 is disengageable from the anchor bracket 33, which is important and advantageous for assisting a caregiver to fold the walker 10 to a compact shape during transport. The tray 40 includes a cup holder 42 and a teething bar 43 monolithically formed with a top surface of the tray 40. The cup holder 42 allows the infant to have a beverage at hand while not requiring them to constantly hold the beverage. Also, such a cup holder 42 conveniently assists in preventing the beverage from toppling over and falling out of the child's reach. The monolithically formed teething bar 43 provides an effective way for an infant to soothe the irritation caused by teeth that are breaking through their gums and advantageously eliminates the possibility of dropping the teething bar 43 on the floor, as might be the case with conventional hand-held teething bars and rings.

The assembly 10 is ideal for use in a variety of situations whether it be at home or during parties and family outings, where a parent might not wish to be holding an infant the whole time. In addition to use by parents, the assembly 10 would also appeal to daycare services and other establishments that are involved with childcare. The walker's foldable and portable design makes it more convenient and easy to use when compared to conventional bulky walkers and strollers, and its simple, yet effective, design greatly reduces production costs.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A child's walker for promoting safety and comfort, said child's walker comprising:

a pair of oppositely spaced A-frames provided with a plurality wheels directly conjoined to a lower portion thereof respectively, each said A-frame having an apex centrally positioned above said wheels respectively wherein said A-frames are pivotal about the respective apexes;

a seat section having a semi-spherical shape nested intermediate of said A-frames such that a child's legs can freely move about when the child is seated within said seat section, said seat section further including a rigid anchor bracket directly conjoined to an anterior surface of said seat section for maintaining said seat section at a substantially stable position during operating conditions; and a tray directly mateable to said anchor bracket in such a manner that said tray protrudes horizontally from said seat section for supporting foodstuff thereon, said tray being disengageable from said anchor bracket for assisting a caregiver to fold said walker to a compact shape during transport;

wherein said seat section is adjustably pivotal about a horizontally registered fulcrum axis passing through the apexes of said A-frames.

2. The walker of claim 1, wherein each said A-frame comprises: a foldable hinge having opposed end portions directly conjoined to a medial region of said A-frames respectively, said foldable hinges being adaptable between folded and expanded positions so that said A-frames can be biased between inoperable and operable positions respectively.

3. The walker of claim 1, wherein said seat section comprises: a pair of detachably engageable straps having lateral end portions directly and permanently attached to said seat section.

4. The walker of claim 1, wherein said anchor bracket is provided with a pair of laterally spaced slots formed therein and positioned adjacent said A-frames, said tray including a plurality of tabs monolithically formed therewith and protruding downwardly from a bottom surface thereof, wherein said tabs are sized and shaped for being removably coupled with the slots so that said tray can be maintained at a substantially stable position during operating conditions.

5. The walker of claim 1, wherein said anchor bracket further comprises:

a plurality of monolithically formed finger portions laterally protruding away from said seat section and centrally registered with the fulcrum axis;

said A-frames being provided with a plurality of frame-securing couplings threadably mateable with said finger portions in such a manner that the caregiver can detach said A-frames from said seat section during transport and storage procedures.

6. The walker of claim 1, wherein said tray comprises:

a cup holder and a teething bar monolithically formed with a top surface of said tray.

7. A child's walker for promoting safety and comfort, said child's walker comprising:

a pair of oppositely spaced A-frames provided with a plurality wheels directly conjoined to a lower portion thereof respectively, each said A-frame having an apex centrally positioned above said wheels respectively wherein said A-frames are pivotal about the respective apexes;

a seat section having a semi-spherical shape nested intermediate of said A-frames such that a child's legs can freely move about when the child is seated within said seat section, said seat section further including a rigid anchor bracket directly conjoined to an anterior surface of said seat section for maintaining said seat section at a substantially stable position during operating conditions, said seat section having a pair of spaced openings for receiving the child's legs therethrough; and a tray directly mateable to said anchor bracket in such a manner that said tray protrudes horizontally from said seat section for supporting foodstuff thereon, said tray being disengageable from said anchor bracket for assisting a caregiver to fold said walker to a compact shape during transport;

wherein said seat section is adjustably pivotal about a horizontally registered fulcrum axis passing through the apexes of said A-frames.

8. The walker of claim 7, wherein each said A-frame comprises: a foldable hinge having opposed end portions directly conjoined to a medial region of said A-frames respectively, said foldable hinges being adaptable between folded and expanded positions so that said A-frames can be biased between inoperable and operable positions respectively.

9. The walker of claim 7, wherein said seat section comprises: a pair of detachably engageable straps having lateral end portions directly and permanently attached to said seat section.

10. The walker of claim 7, wherein said anchor bracket is provided with a pair of laterally spaced slots formed therein and positioned adjacent said A-frames, said tray including a plurality of tabs monolithically formed therewith and protruding downwardly from a bottom surface thereof, wherein said tabs are sized and shaped for being removably coupled with the slots so that said tray can be maintained at a substantially stable position during operating conditions.

11. The walker of claim 7, wherein said anchor bracket further comprises:

a plurality of monolithically formed finger portions laterally protruding away from said seat section and centrally registered with the fulcrum axis;

said A-frames being provided with a plurality of frame-securing couplings threadably mateable with said finger portions in such a manner that the caregiver can detach said A-frames from said seat section during transport and storage procedures.

12. The walker of claim 7, wherein said tray comprises:

a cup holder and a teething bar monolithically formed with a top surface of said tray.

13. A child's walker for promoting safety and comfort, said child's walker comprising:

a pair of oppositely spaced A-frames provided with a plurality wheels directly conjoined to a lower portion thereof respectively, each said A-frame having an apex centrally positioned above said wheels respectively wherein said A-frames are pivotal about the respective apexes;

a seat section having a semi-spherical shape nested intermediate of said A-frames such that a child's legs can freely move about when the child is seated within said seat section, said seat section further including a rigid anchor bracket directly conjoined to an anterior surface of said seat section for maintaining said seat section at a substantially stable position during operating conditions, said seat section having a pair of spaced openings for receiving the child's legs therethrough, said seat section being formed from flexible padded material; and a tray directly mateable to said anchor bracket in such a manner that said tray protrudes horizontally from said seat section for supporting foodstuff thereon, said tray being disengageable from said anchor bracket for assisting a caregiver to fold said walker to a compact shape during transport;

wherein said seat section is adjustably pivotal about a horizontally registered fulcrum axis passing through the apexes of said A-frames.

14. The walker of claim 13, wherein each said A-frame comprises: a foldable hinge having opposed end portions directly conjoined to a medial region of said A-frames respectively, said foldable hinges being adaptable between folded and expanded positions so that said A-frames can be biased between inoperable and operable positions respectively.

15. The walker of claim 13, wherein said seat section comprises: a pair of detachably engageable straps having lateral end portions directly and permanently attached to said seat section.

16. The walker of claim 13, wherein said anchor bracket is provided with a pair of laterally spaced slots formed therein and positioned adjacent said A-frames, said tray including a plurality of tabs monolithically formed therewith and protruding downwardly from a bottom surface thereof, wherein said tabs are sized and shaped for being removably coupled with the slots so that said tray can be maintained at a substantially stable position during operating conditions.

17. The walker of claim 13, wherein said anchor bracket further comprises:

a plurality of monolithically formed finger portions laterally protruding away from said seat section and centrally registered with the fulcrum axis;

said A-frames being provided with a plurality of frame-securing couplings threadably mateable with said finger portions in such a manner that the caregiver can detach said A-frames from said seat section during transport and storage procedures.

18. The walker of claim 13, wherein said tray comprises:

a cup holder and a teething bar monolithically formed with a top surface of said tray.

* * * * *